US005832346A

United States Patent [19]

Lewis

[11] Patent Number: 5,832,346

[45] Date of Patent: Nov. 3, 1998

[54] MULTI-POINT CONTACT CHARGING DEVICE

[75] Inventor: Richard B. Lewis, Williamson, N.Y.

[73] Assignee: Xerox Corporation, Stamford, Conn.

[21] Appl. No.: 939,642

[22] Filed: Sep. 29, 1997

[51] Int. Cl.[6] ..... G03G 15/02

[52] U.S. Cl. ..... 399/168; 399/174; 361/225; 430/902

[58] Field of Search ..... 399/174, 175, 399/176, 168; 430/902; 361/225, 230, 235

[56] References Cited

U.S. PATENT DOCUMENTS

| | | | |
|---|---|---|---|
| 3,684,364 | 8/1972 | Schmidlin | 355/3 |
| 4,336,565 | 6/1982 | Murray et al. | 361/225 |
| 4,387,980 | 6/1983 | Ueno et al. | 399/174 |
| 4,761,709 | 8/1988 | Ewing et al. | 361/225 |
| 5,499,080 | 3/1996 | Furuya et al. | 355/208 |
| 5,602,626 | 2/1997 | Facci et al. | 399/135 |
| 5,781,833 | 7/1998 | Lewis et al. | 399/168 |

*Primary Examiner*—Joan Pendegrass
*Attorney, Agent, or Firm*—Denis A. Robitaille

[57] ABSTRACT

An device for applying an electrical charge to a member to be charged such as a charge retentive surface in an electrostatographic printing apparatus, including a multi-contact point conductive charging device positioned in contact with the member to be charged. The charging device includes multiple electrically isolated conductive blades which are independently electrically biased at predetermined voltage levels so as not to exceed a Paschen threshold voltage differential. Alternative embodiments are disclosed incorporating conductive blade members, as well as ionically conductive liquid carrying donor members. In operation, the charging device of the present invention permits generation of a charge potential on the photoreceptor significantly greater than the Paschen threshold voltage, while avoiding air breakdown.

15 Claims, 3 Drawing Sheets

MULTI-POINT CONTACT CHARGING DEVICE

Figure 1:
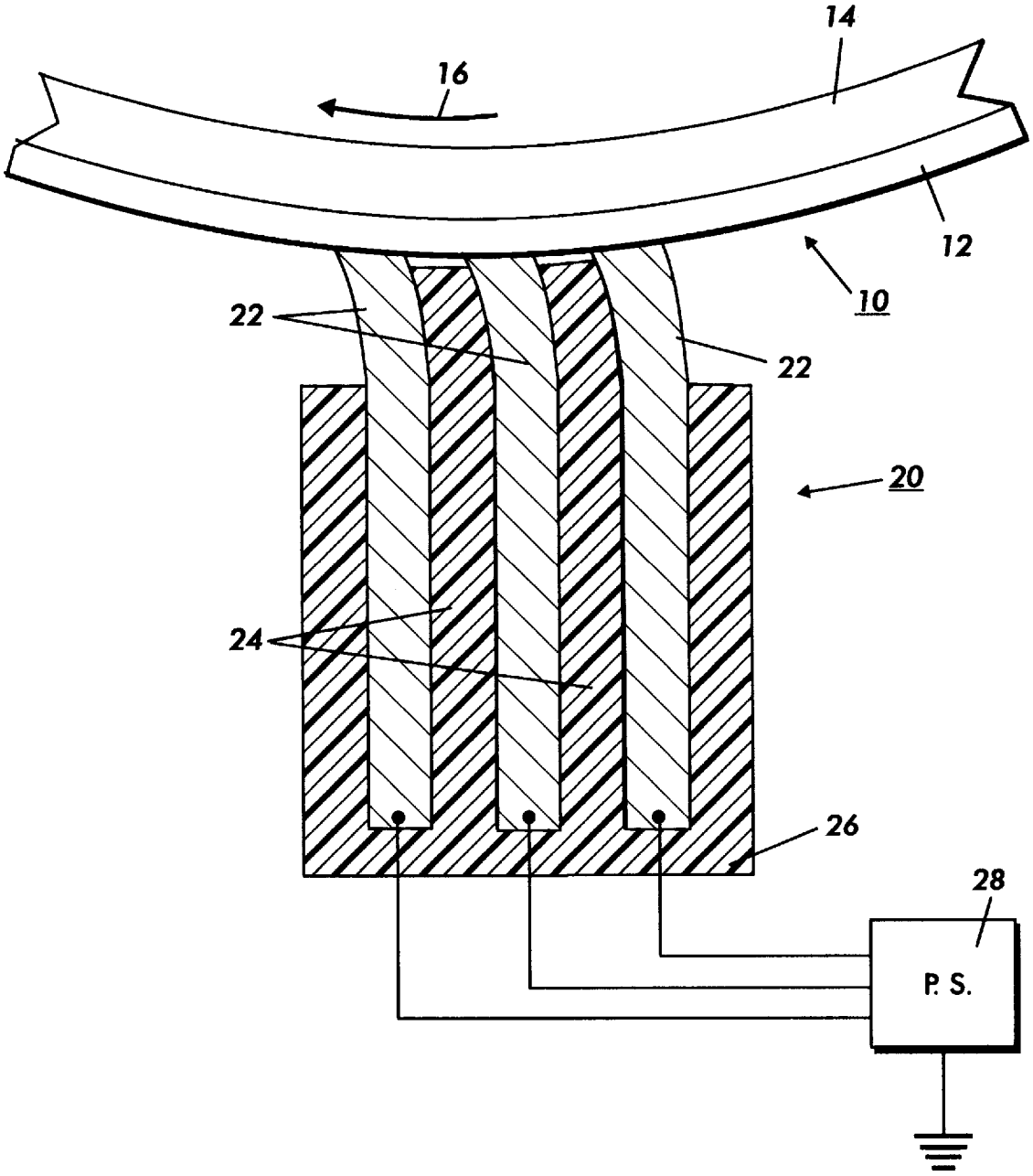

The present invention relates generally to a contact charging apparatus for applying a charge potential to a surface in contact therewith, for example, to charge an imaging member such as a photoreceptor in an electrostatographic printing machine. More specifically, this invention concerns a multi-point contact charging apparatus, wherein each blade provides a gradually increasing charge potential at the point of contact with the surface to be charged.

Generally, the process of electrostatographic reproduction is initiated by exposing a light image of an original document to a substantially uniformly charged photoreceptive member. Exposing the charged photoreceptive member to a light image discharges the photoconductive surface thereof in areas corresponding to non-image areas in the original document, while maintaining the charge in areas corresponding to image areas, thereby creating an electrostatic latent image of the original document on the photoreceptive member. This latent image is subsequently developed into a visible image by a process in which a developing material is deposited onto the photoconductive surface such that the developing material is attracted to the charged image areas on the photoreceptor. Thereafter, the developing material is transferred from the photoreceptive member to a copy sheet or some other image support substrate to which the image may be permanently affixed for producing a "hard copy" output of the original document. In a final step in the process, the surface of the photoreceptive member is cleaned to remove any residual developing material and/or charge therefrom in preparation for subsequent imaging cycles.

The above-described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as discharged area development (DAD), or "write black" systems, as opposed to systems which develop toner on the charged areas, known as charged area development (CAD), or "write white" systems. The subject invention applies to both such systems.

Various devices and apparatus are known for applying a uniform electrostatic charge or charge potential to a photoconductive surface prior to the formation of the latent image thereon. Typically, a well-known corona generating device is utilized for applying charge to the photoreceptor, wherein one or more fine conductive electrodes is biased at a high voltage potential, causing ionization of surrounding air which, in turn, results in the deposit of an electrical charge on an adjacent surface, namely the photoreceptor. In addition to charging the photoreceptor of an electrostatographic system prior to exposure, a corona generating device of the type described, a so-called corotron, can be used in the transfer of an electrostatic toner image from a photoreceptor to the copy sheet, in tacking and detacking a copy sheet to/or from the photoreceptor by neutralizing charge on the sheet, and, generally, in conditioning the photoconductive imaging surface of the photoreceptor prior to, during, and after the deposition of toner thereon for improving the quality of the xerographic output print. Each of these functions is typically accomplished by a separate and independent corona generating device such that a relatively large number of devices within a single machine necessitates the economical use of such corona generating devices.

Several problems have been associated with corona generating devices. Most notably, problems exist with respect to providing a uniform charge density along the entire length of the corona generating electrode, resulting in a corresponding variation in the magnitude of charge deposited on associated portions of the adjacent surface being charged. Other problems exist with respect to the use of very high voltages (6000–8000 V), which may lead to: a requirement for the use of particular insulating materials; the generation of low charging efficiencies; and arcing caused by non-uniformities between the corotron electrode (coronode) and the surface being charged. Other problems tend to exist with respect to vibration and sagging of coronode wires, and, in general, inconsistent charging performance due to the effects of humidity and airborne chemical contaminants on and around the corona generating device. Most significantly, corotron devices generate ozone, resulting in well-documented health and environmental hazards. Corona charging devices also generate oxides of nitrogen which eventually desorb from the corotron, causing oxidation of various machine components which may result in an adverse effect on the quality of the final output print.

Various approaches and solutions to the numerous problems associated with suspended wire corona generating charge devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of a glass coated secondary electrode.

In addition, alternatives to suspended wire corona generating charging systems have been developed. For example, roller charging systems, as exemplified by U.S. Pat. Nos. 2,912,586 to Gundlach; 3,043,684 to Mayer; and 3,398,336 to Martel et al., as well as contact brush charging devices, as exemplified by U.S. Pat. Nos. 4,761,709 to Ewing et al.; 4,336,565 to Murray et al.; and 5,245,386 to Asano et al. have been disclosed and discussed in numerous articles of technical literature. Such alternative devices operate via discharge from the charging member to the member to be charged. One disadvantage that is encountered when employing the foregoing alternative charging systems such as rollers or contact brushes is the presence of air breakdown in the area adjacent to the initial contact point between the contact member and the surface to be charged. That is, it is well known that when two conductors are held near each other with a voltage applied between the two, electrical discharge will occur as the voltage is increased to a critical point at which a discharge current is created in the air gap between the conductors. This point is commonly known as the Paschen threshold voltage. This discharge induces non-uniform charging and is usually accompanied by a visible but undesirable electrical discharge.

One more recent approach to charging as disclosed, for example in U.S. Pat. No. 5,602,626, involves a device for charging photoconductive imaging members via ionic conduction through a fluid or liquid media such as water, wherein corona charging devices and other known devices for inducing a charge on an adjacent surface, together with their known disadvantages, can be avoided.

The present invention relates to a device for charging photoconductive imaging members via a contact charging device, wherein the use of corona generating devices for inducing a charge on an adjacent surface, together with their known disadvantages, can be avoided. Moreover, the present invention relates to a contact charging apparatus, wherein the phenomenon of air breakdown can be avoided. In particular, the present invention is directed toward a multi-contact point graded potential contact charging apparatus including a plurality of contact elements contacting the surface to be charged, wherein each contact element is provided with a gradually increasing bias voltage which is substantially less than the Paschen threshold voltage at which a discharge current is created, for avoiding air breakdown during the charging process. The present invention may also be incorporated into an ionically conductive liquid charging apparatus of the type disclosed in previously referenced U.S. Pat. No. 5,602,626.

The following disclosures may be relevant to various aspects of the present invention:

U.S. Pat. No. 3,684,364 Patentee: Schmidlin
Issued: Aug. 15, 1972

U.S. Pat. No. 4,336,565 Patentee: Murray et al.
Issued: Jun. 22, 1982

U.S. Pat. No. 4,761,709 Patentee: Ewing et al.
Issued: Aug. 2, 1988

U.S. Pat. No. 5,499,080 Patentee: Furuya et al.
Issued: Mar. 12, 1996

U.S. Pat. No. 5,602,626 Patentee: Facci et al.
Issued: Feb. 11, 1997

The relevant portions of the foregoing disclosures may be briefly summarized as follows:

U.S. Pat. No. 3,684,364 discloses a solution the problem of electric breakdown in air at the initial and final contact points of a roller electrode with a reproductive surface, whereby a graded potential is provided to the roller electrode over the area of contact with the reproductive surface. By selecting appropriate low level potentials for the initial and final contact points, air breakdown is avoided. The graded potential can be provided to the roller by means of a plurality of sliding contacts and resistivity interconnected electrodes arranged about the circumference of the roller extending sufficiently through the roller to provide the requisite field to the reproducing surface beneath.

U.S. Pat. No. 4,336,565 discloses a process for imposing an electrical charge on an electrically insulating surface of a moving web wherein a brush electrode contacts the surface. The brush is made up of extremely soft and flexible fiber filaments comprising carbon mounted on a metallic brace which also serves as an electrical contact to supply the brush with DC potential, whereby the electrically insulating surface is charged to nearly the potential applied to the brush. In order to improve charge uniformity the brush is oscillated in a direction transverse to the direction of web movement.

U.S. Pat. No. 4,761,709 discloses a contact brush charging device together with a method for charging an insulating layer, wherein the charging brush comprises a plurality of resiliently, flexible thin fibers having an electrical resistivity of from about $10^2$ ohms-cm to about $10^6$ and being substantially resistivity stable to changes in relative humidity and temperature. In a preferred embodiment the plurality of fibers are arranged in a uniform distribution of fibers along the length of the brush and comprise partially carbonized polyacrylonitrile fibers having an electrical resistivity from about $10^3$ ohms-cm to about $10^5$ ohms-cm and being substantially homogeneous in composition.

U.S. Pat. No. 5,499,080 discloses a charging apparatus including a charging member for charging the member to be charged; a power source for supplying electric power to the charging member; a power source for supplying a constant small DC current to the charging member; and a device for determining a voltage to be applied to the charging member; wherein while the constant small DC current is supplied to the charging member, a voltage supplied to the charging member is detected and in response to the detected voltage, the voltage determining device determines the voltage to be applied to the charging member.

U.S. Pat. No. 5,602,626 discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

In accordance with the present invention, a charging device for applying an electrical charge to a member to be charged is provided, comprising: a plurality of electrically isolated conductive charging members, each positioned in contact with the member to be charged at an independent sequential contact point therewith; and means for applying an independent electrical bias to each of the plurality of conductive charging members such that each conductive charging member is operative to create a charge potential on the member to be charged. The independent electrical bias applied to any selected one of the plurality of conductive charging members does not exceed a Paschen threshold voltage relative to a voltage differential between the selected conductive charging member and the charge potential on said member to be charged. In addition, the independent electrical bias applied to each of said plurality of conductive charging members is incrementally increased with respect to each independent sequential contact point thereof.

In accordance with another aspect of the invention, an electrostatographic printing machine is provided, including a charging device for applying an electrical charge to an imaging member, comprising a plurality of electrically isolated conductive charging members, each positioned in contact with the imaging member at an independent sequential contact point therewith, and means for applying an independent electrical bias to each of the plurality of conductive charging members such that each of the plurality of conductive charging members is operative to create a charge potential on the imaging member.

In accordance with another aspect of the invention, a charging device for applying an electrical charge to a member to be charged is provided, comprising: a first conductive charging member positioned in contact with the member to be charged at a first contact point whereat the member to be charged is at a substantially neutral electrical potential; a first electrical biasing source coupled to the first conductive charging member for applying an electrical bias thereto which is less than the Paschen threshold voltage at which electrical discharge occurs between the first conductive charging member and the member to be charged; a second conductive charging member positioned in contact with the member to be charged at a second contact point adjacent the first contact point whereat the member to be charged is at an electrical potential induced by the first conductive charging member; and a second electrical biasing source coupled to the second conductive charging member for applying an electrical bias thereto which is greater than the Paschen threshold voltage level at which electrical discharge occurs relative to a voltage differential between the second conductive charging member and the member to be charged when at a substantially neutral electrical potential level, but which is less than the Paschen threshold voltage level at which electrical discharge occurs between the second conductive charging member and the member to be charged at an electrical potential induced by the first conductive charging member.

In accordance with yet another aspect of the present invention, a method for applying an electrical charge to a member to be charged, comprising the steps of providing a first conductive charging member positioned in contact with the member to be charged at a first contact point whereat the member to be charged is at a substantially neutral electrical potential; applying an electrical bias to the first conductive charging member which is less than the Paschen threshold voltage at which electrical discharge occurs between the first conductive charging member and the member to be charged; providing a second conductive charging member positioned in contact with the member to be charged at a second contact point adjacent the first contact point whereat the member to be charged is at an electrical potential induced by the first conductive charging member; and applying an electrical bias to the second conductive charging member which is greater than the Paschen threshold voltage level at which electrical discharge occurs relative to a voltage differential between the second conductive charging member and the member to be charged when at a substantially neutral electrical potential level, but which is less than the Paschen threshold voltage level at which electrical discharge occurs between the second conductive charging member and the member to be charged at an electrical potential induced by the first conductive charging member.

Figure 2:
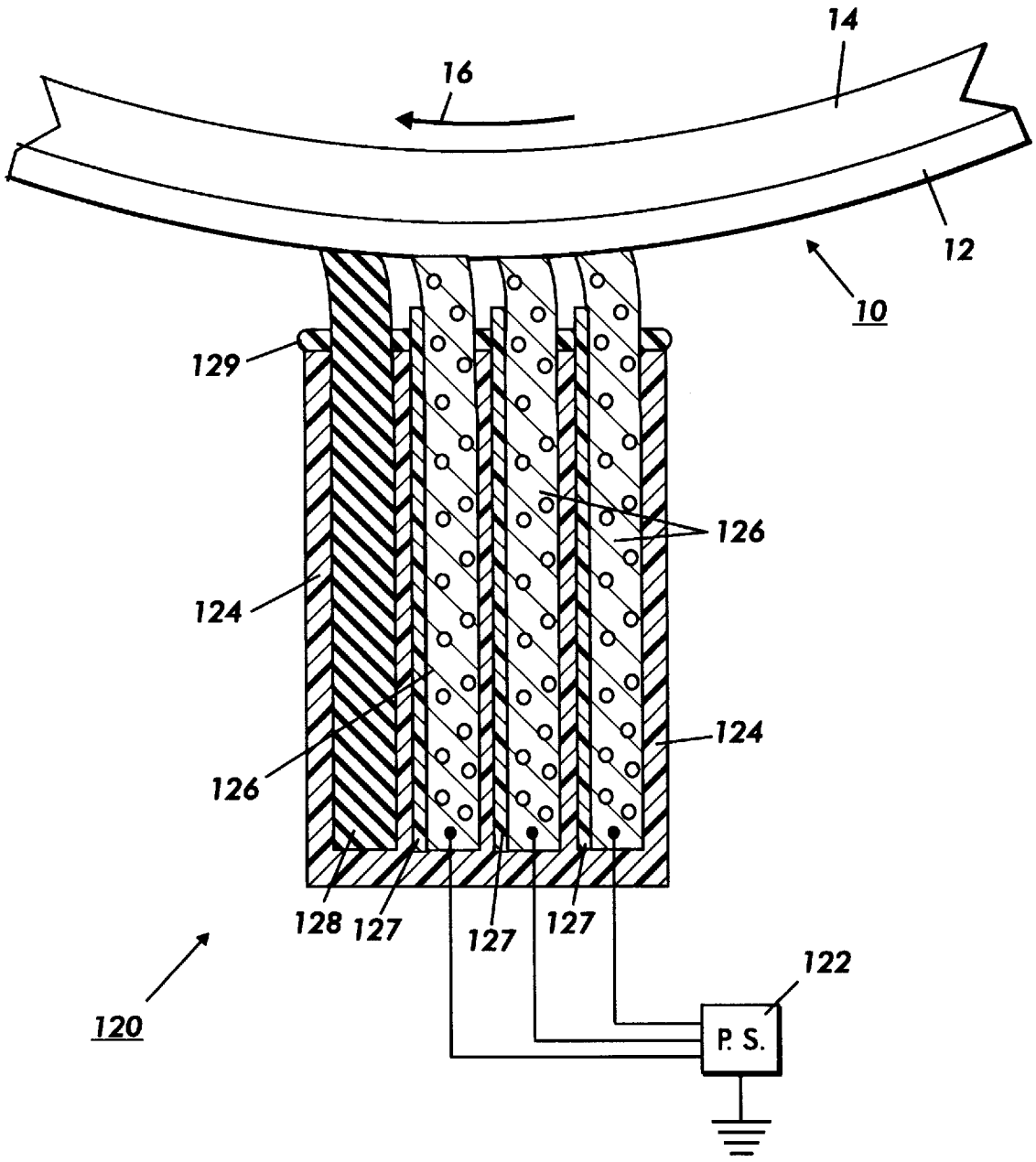
Figure 3:
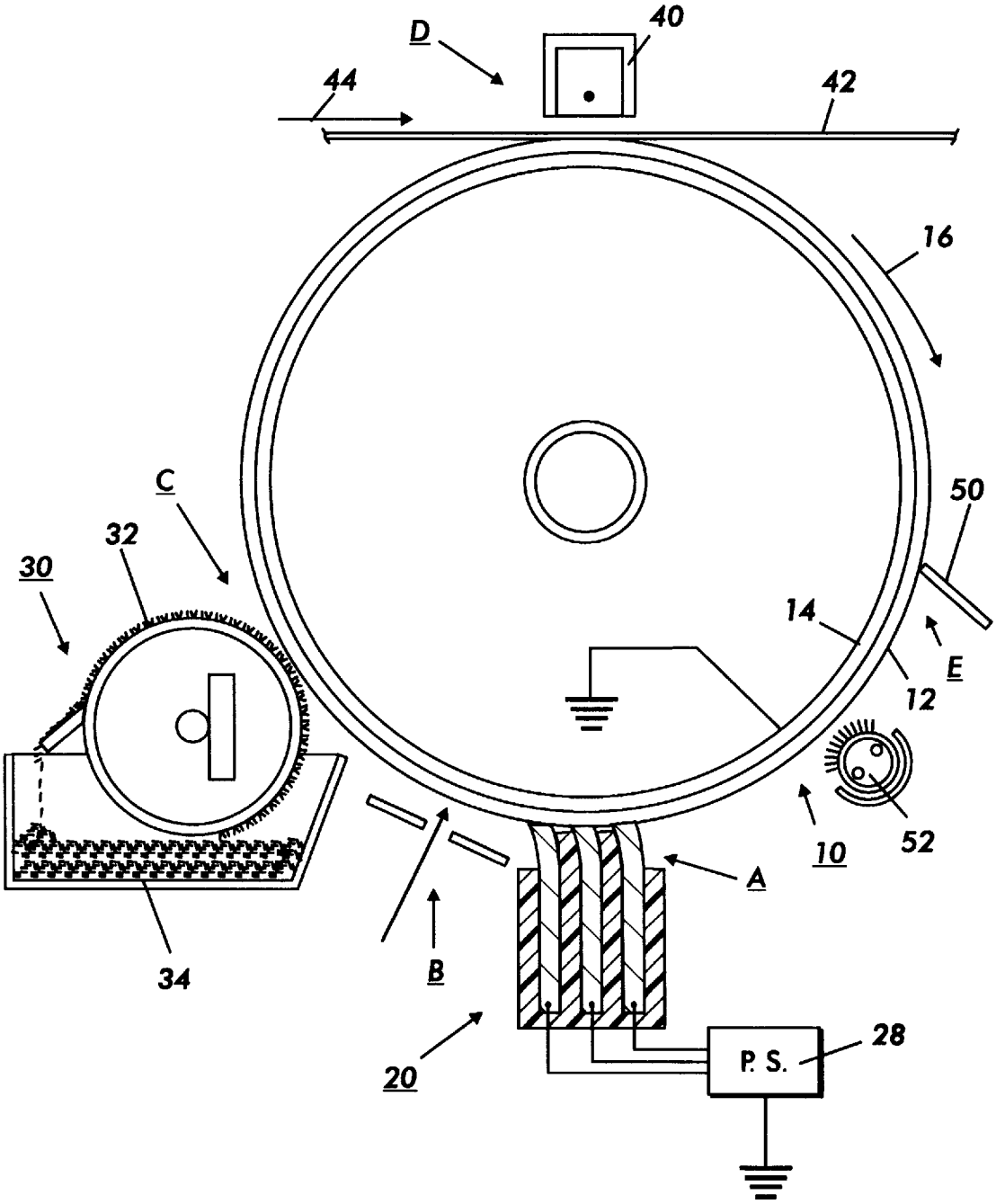

These and other aspects of the present invention will become apparent from the following description in conjunction with the accompanying drawings in which:

FIG. 1 is a cross sectional side view of a multi-point contact charging device in accordance with the present invention;

FIG. 2 is a cross-sectional view showing an alternative embodiment of a multi-point contact charging device in accordance with the present invention, wherein the multi-point charging device is embodied as an ionically conductive liquid charging apparatus; and FIG. 3 is a schematic elevational view showing an electrostatographic copying apparatus employing the multi-point contact charging device of the present invention.

For a general understanding of the features of the present invention, reference is made to the drawings wherein like reference numerals have been used throughout to designate identical elements. While the present invention will be described in connection with a preferred embodiment thereof, it will be understood that the invention is not limited to this preferred embodiment. On the contrary, the present invention is intended to cover all alternatives, modifications, and equivalents as may be included within the spirit and scope of the invention as defined by the appended claims.

Referring initially to FIG. 2 prior to describing the invention in detail, a schematic depiction of the various components of an exemplary electrostatographic reproducing apparatus incorporating the multi-point contact charging device of the present invention is provided. Although the apparatus of the present invention is particularly well adapted for use in an automatic electrostatographic reproducing machine, it will be understood that the instant charging device is equally well-suited for use in a wide variety of electrostatographic-type processing machines as well as other charging applications, and is not necessarily limited in its application to the particular embodiment or embodiments shown herein.

The exemplary electrostatographic reproducing apparatus of FIG. 3 employs a drum photoreceptor 10 including a photoconductive surface 12 deposited on an electrically grounded conductive substrate 14. A motor (not shown) is coupled to the drum 10 for rotating the photoconductive surface 12 in the direction of arrow 16, thereby advancing successive portions of the photoconductive surface 12 through various processing stations disposed about the path of movement thereof, as will be described.

Initially, a portion of the photoconductive surface 12 passes through a charging station, generally identified by reference letter A, where a charging device 20 in accordance with the present invention is utilized to charge the photoconductive surface 12 to a relatively high, substantially uniform potential. In general, the charging device 20 in accordance with the present invention comprises an apparatus adapted to contact a plurality of blade contact members to the surface of drum 10, wherein gradually increasing biasing potentials are applied to each blade contact member, for enabling the application of gradually increasing charge potential to the photoreceptor surface as the drum 10 rotates past the contact charging device 20. The photoconductive surface 12 thus becomes electrically charged via contact with the electrically biased blade members, in contrast to the application of a charge via a corotron or other corona generating device. A detailed description of a charging device in accordance with the present invention will be provided following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document. One skilled in the art will appreciate that various methods may be utilized to irradiate the charged portion of the photoconductive surface 12 for recording the latent image thereon, including, for example, a properly modulated scanning beam such as a laser beam provided by means of a raster output scanning apparatus.

After the electrostatic latent image is recorded on the photoconductive surface 12, the drum 10 is advanced to development station C where a development system, such as a magnetic brush developer, indicated generally by the reference numeral 30, deposits developing material onto the electrostatic latent image to create a developed image. The exemplary magnetic brush development system 30 shown in FIG. 2 includes a developer housing 34, in which toner particles are mixed with carrier beads to create an electrostatic charge therebetween, causing the toner particles to cling to the carrier beads to form the developing material. A developer roller 32 rotates and attracts the developing material to the surface thereof, forming a magnetic "brush" of developing material magnetically attached to the roller. As the magnetic brush rotates, the developing material is brought into contact with the photoconductive surface 12 such that the latent image thereon attracts the toner particles of the developing material to form a developed toner image on photoconductive surface 12. It will be understood by those of skill in the art that numerous types of development systems could be substituted for the magnetic brush development system shown and described herein.

After the toner particles have been deposited onto the electrostatic latent image for development thereof, drum 10 advances to transfer station D, where a sheet of support material 42 is transported in a timed sequence into contact with the developed toner image so that the developed image on the photoconductive surface 12 contacts a advancing sheet of support material 42 at transfer station D. A charging device 40 is provided for creating an electrostatic charge on the backside of support material 42 to aid in inducing the transfer of toner from the developed image on photoconductive surface 12 to the support material 42. While a conventional coronode device is shown to represent charge generating device 40, it will be understood that various charging devices, including the graded potential charging device of the present invention, may be substituted for the corona generating device 40 for providing the electrostatic charge which induces toner transfer to the support material 42. However, it will be recognized that the use of a contact charging device at the transfer station may produce undesirable effects due to the contact thereof with the drum and/or support material, such that the use thereof may not be practical. After image transfer, the support material 42 is subsequently transported in the direction of arrow 44 for placement onto a conveyor (not shown) which advances the sheet to a fusing station (also not shown) for permanently affixing the transferred image to the support material 42 for subsequent removal of the finished copy or print.

Often, after the support material 42 is separated from the photoconductive surface 12 of drum 10, some residual developing material remains in contact with to the photoconductive surface 12. Thus, a final processing station, namely cleaning station E, is provided for removing residual toner particles from photoconductive surface 12 in preparation for a subsequent imaging cycle subsequent to separation of the support material 42 from drum 10. Cleaning station E can include various mechanisms, such as a simple blade element 50, as shown, or a rotatably mounted fibrous brush (not shown), as disclosed, for example, in commonly assigned U.S. Pat. No. 4,706,320. The mechanism of cleaning station E is typically adapted for physical engagement with photoconductive surface 12 to remove residual toner particles therefrom. Cleaning station E may also include a discharge lamp 52 for flooding the photoconductive surface 12 with light in order to dissipate any residual electrostatic charge remaining thereon.

The foregoing description should be sufficient for purposes of description to illustrate the general operation of an electrostatographic reproducing apparatus incorporating the features of the present invention. As described, an electrostatographic reproducing apparatus may take the form of any of several well known systems. Variations of the specific electrostatographic processing subsystems or processes described herein may be expected without affecting the operation of the present invention. For example, to those skilled in the art, the photoconductive coating of the photoreceptor may be placed on a flexible belt of either seamed or unseamed construction, continuous or not, without affecting the operation of the present invention. However, it will be recognized that a sufficiently rough seam may disturb or damage the charging blade members of the instant contact charging device.

Referring now, more particularly, to contact charging devices to which the specific subject matter of the present invention is directed, an exemplary multi-contact point charging device in accordance with the present invention will be described in greater detail with reference to FIG. 1. By way of background, charging in the electrostatographic printing process involves the provision of an electrical charge on an electrically neutral and grounded photoreceptive member which acts as an insulator when not exposed to light. By contacting an electrically biased electrode to the grounded electrically insulating surface of the photoreceptor in a dark environment, electrical discharge occurs from the charging member to the member to be charged, whereby the insulative photoreceptor becomes charged to a voltage potential as a result of the discharge of the voltage from the contact member. Thus, an electrically conductive electrode having a voltage applied thereto is placed in contact with the surface of the photoconductive imaging member in its insulative state, such that the photoreceptor becomes charged by electrical discharge from the biased electrode in contact therewith. This process can provide a substantially uniform constant voltage charging operation, especially when the contact zone contains water or another ion-transporting medium. Moreover, in comparison to charging processes utilizing a corona generating device, wherein ions are sprayed onto the photoreceptor through a gaseous media as occurs in a corotron or similar corona generating-type device, and wherein the corotron is typically biased to a potential as high as 8,000 to 10,000 volts in order to provide a photoreceptor charge voltage on the order of 800 volts, the contact charging process can be highly efficient with for example, 1,000 volts being applied to the contact electrode charging member in order for, the photoreceptor to become charged to approximately 800–900 volts. Thus, contact charging is generally much more efficient than corona charging processes. This more efficient contact charging process also has the added benefit of eliminating, or at least significantly decreasing, the amount of ozone generated during the charging process.

Despite the advantages associated with contact charging, conventional contact charging systems comprise a single contact member in the form of a roll, a blade member, or a brush. The voltage required to be applied to the single contact member to provide the required charge levels in the electrostatographic process is generally greater than the Paschen threshold voltage at which air breakdown occurs. As a result, in such contact charging devices, a small but significant air breakdown region is formed immediately adjacent to the point of contact between the contact member and the photoreceptor, in the region at which the upstream surface of the photoreceptor makes initial contact with the contact charging member. Such air breakdown generates ozone and may lead to the deposit of non-uniform regions of charge on the photoreceptor, resulting in distorted image quality. The present invention is directed toward a multi-contact point charging member, wherein the problem of air breakdown can be avoided by providing a gradually increasing biasing potential at multiple contact points, with each gradually increasing biasing potential generating a potential difference relative to the photoreceptor surface that is less than the Paschen threshold voltage which would generate air breakdown.

Moving now to an exemplary embodiment of the specific subject matter of the present invention, a multi-blade contact charging device is illustrated in FIG. 1. The charging device 20 includes a plurality of contact charging blades 22. Each blade member 22 is substantially similar, preferably being relatively flexible in nature and preferably fabricated from a conductive elastomer such as a carbon loaded silicone rubber or any fluoroelastomer or polyurethane material which may be treated to be conductive in any manner known in the art. In a preferred embodiment the specific elastomer was a black conducting silicone available from I. S. Moore of Lexington, Ky. wherein the material is characterized by a hardness of approximately 60 durometer, with a resistivity of approximately $10^5$ ohm centimeters. The blade member 22 may also be fabricated from a polymer, for example VITON®, a copolymer of vinylidene fluoride/hexafluoropropylene, or terpolymers of vinylidene fluoride/hexafluoropropylene and tetrafluoroethylene, modified to include a conductive carbon black material in a range of approximately 10–30% by weight. It will be understood that any conductive material may be used to provide the blades 22 in the practice of the present invention. Alternatively, it will be understood that each charging blade 22 may be provided in the form of a brush type device comprised of a plurality of uniformly distributed resilient and flexible fibers as disclosed, for example, in previously referenced U.S. Pat. No. 4,761,709. Additionally, other contact type devices which are known in the art may also be provided, an example of which will be described hereinbelow.

Each charging blade 22 is separated by an insulative member 24 for electrically isolating each charging blade 22 from an adjacent charging blade 22. In the exemplary embodiment of FIG. 1, multiple insulative members 24 are provided as integral portions of a housing 26 for furnishing a mounting assembly to support the multiple contact blades 22 in a position adjacent to the photoconductive member 10. As can be seen from FIG. 1, it is contemplated that the support housing 26 is fabricated from a relatively rigid material relative to blade elements 22, providing structural rigidity for urging blade elements 22 into contact with the photoreceptor surface 12 in a springloaded manner. Those of skill in the art will understand that various materials and structures may be utilized to accomplish the same results.

In accordance with the present invention, each conductive blade 22 is independently coupled to a DC voltage power supply 28 for applying independent biasing voltages to each conductive blade 22. Power supply 28 is adapted to supply an array of different biasing voltages through each lead connected to each independent conductive blade 22. In order to insure that air breakdown does not occur while also insuring that a sufficient charge level is established on the photoconductor 10, an incrementally increasing bias voltage is applied to each contact blade 22 relative to the process direction of the photoconductive surface. The desired voltage profile is generated by providing a predetermined voltage level to each contact blade member 22.

The manner in which the multi-point contact device of the present invention accomplishes the elimination of air breakdown will now be described by means of an illustrative example, wherein the Paschen threshold voltage is assumed to be approximately 500 volts, while the desired charge potential of the photoreceptor is assumed to be approximately 800 volts. A charging blade having approximately 90% charge efficiency is also assumed. By applying a bias potential to the first contact blade 22 of about 300 volts, the Paschen threshold is not exceeded and a charge of approximately 270 volts is applied to the photoreceptor. Next, a bias voltage of approximately 600 volts is applied to the second contact blade 22, such that the voltage differential between the blade (600 v) and the photoreceptor (270 v) still does not exceed the Paschen threshold voltage, while a charge voltage of approximately 530 volts is established on the photoreceptor. Finally, a bias voltage of approximately 900 volts can be applied to the next contact blade 22 without exceeding the Paschen threshold voltage while establishing a charge potential on the photoreceptor of approximately 810 volts. It will be understood that the assumptions and voltages used in the above description may vary significantly depending on materials and system characteristics without changing the basic concept of the present invention.

Thus, as illustrated hereinabove, the multi-point contact charging device of the present invention provides the capability to apply an electrical charge to a member in contact therewith without exceeding the Paschen threshold voltage. This eliminates air breakdown, and at least one photoreceptor degradation mechanism. In addition, the need for ozone management and filtration is eliminated, decreasing the unit manufacturing cost of a machine while presenting a lower health hazard relative to machines using typical corona generating devices. Typical voltages provided by the power supply 22 might range from about −1000 V to about +1000 V, and preferably between about ±400 to about ±700. As previously noted, the voltage that is applied to the photoconductive surface 12 is substantially equal to the voltage applied to the conductive blade 22 such that a voltage of 750 volts, for example, applied to the blade 22 may result in a voltage of about 700 volts or slightly less on the photoreceptor. The voltage supplied by the power source 28 can be of a positive or negative polarity, with the polarity of the charge deposited by the conductive blade 22 being controlled exclusively by the polarity of the supplied voltage. Thus, the application of a positive bias to the blades 22 causes positive charge to transfer to the photoreceptive member, while the application of a negative bias to the blade causes negative charge to transfer to the photoreceptive member.

Despite the various advantages associated with a multi-point contact charging device of the type described hereinabove, it is very difficult to accomplish a substantially uniform charging process without some air breakdown since the contact intimacy required between the conductive elastomer and the photoreceptor is very great. As a result, an alternative embodiment for practicing the present invention is contemplated, wherein the content of the present invention is incorporated into an ionically conductive charging apparatus of the type described, for example in U.S. Pat. No. 5,602,626. This alternative embodiment will be described with reference to FIG. 2, wherein the specific embodiment of the present invention is directed to a device for charging a photoreceptor 10 by the transfer of ions thereto. In general, the present invention comprises an apparatus which is suitable for contacting a liquid material like distilled water or deionized water, or some other liquid material which may include a gelling agent, as will be discussed, with the surface 12 of the photoreceptor 10. A voltage is applied to the liquid material while the photoreceptor 10 is rotated or transported relative to the liquid material, thereby enabling the transfer of ions, preferably of a single sign, such as positive or negative polarity, from the liquid/photoreceptor interface to the photoreceptor surface 12. The photoreceptor surface 12 thus becomes charged by the voltage applied to the liquid component in contrast to applying a voltage directly to the photoreceptor via a corona generating or other charging device.

The ionically conductive liquid charging apparatus of this alternative embodiment is comprised of a housing 124 for supporting a plurality of wetted liquid donor blades 126 in contact with the surface 12 of photoreceptor 10. Housing 124 is fabricated of an insulative material such as a polymer. Preferably, the housing 124 is fabricated from a material which is not susceptible to corrosion upon exposure to the particular ionically conductive liquid utilized by the ionically conductive liquid charging apparatus. The housing 124 may also serve as a reservoir for storing an amount of the ionically conductive liquid used to wet the liquid donor blades 126 supported therein.

Examples of ionically conductive liquid materials which may serve satisfactorily in the context of the present embodiment include any liquid based material capable of conducting ions, including simple tap water and even distilled or deionized water (where the conductivity thereof is believed to be caused by the known dissolution of carbon dioxide in water). Components which can be added to the water to render it more ionically conductive include atmospheric carbon dioxide ($CO_2$), lithium carbonate, sodium carbonate, potassium carbonate, sodium bicarbonate and the like. The concentration ranges can vary from trace levels to saturation. Another example of an ionically conductive medium is a gel that is composed of 96 wt % water and 4 wt % acrylic acid neutralized with NaOH. Other hydrogels include polyhydroxyethylmethacrylates, polyacrylates, polyvinylpyrrolodonone and the like. Other gel materials include gelatin, gums and mucilages both natural and synthetic. Numerous other fluid compounds and materials which may be desirable for use with the apparatus of the present embodiment are described in commonly assigned U.S. Pat. No. 5,510,879, issued on Apr. 12, 1996 entitled Photoconductive Charging Processes.

Donor blades 126 are relatively flexible blade members which may be fabricated from a porous or microporous elastomeric polymer like polyurethane of polyvinylalcohol-co-polyvinylformal (polyvinyl crosslinked with formaldehyde) which provides for bringing the pure liquid or ionically conductive liquid in contact with the photoreceptor 12. The blade members should be wettable, preferably hydrophilic by the particular ionically conductive liquid being utilized, especially when the liquid is water. For example, polyurethane foam, compressed polyurethane foam, or polyvynilalcohol-co-polyvynilformal foam can be used to provide a compliant blade member. Alternatively, the donor blades 126 can be fabricated from a hydrophobic polymer, for example VITON®, a copolymer of vinylidene fluoride/hexafluoropropylene and tetrafluoroethylene. The surface of the blade can be chemically treated so as to make it hydrophilic. For example, it may be treated by exposure to ozone gas, or other oxidizing agents such as chromic acid. Yet another way of making a surface, such as VITON®, hydrophilic is to roughen it with fine sand paper. Other hydrophobic polymers for the donor blade include polyethylene, polypropylene, polyethylpentane, polybutadiene and silicone elastomers.

The surface of the blade members 126 may alternatively be rendered hydrophilic by filling the elastomer with finely divided conductive particles, such as aluminum, zinc or oxidized carbon black, aluminum oxide, tin oxide, titanium dioxide, zinc oxide and the like, to the extent of 0.1 to 10 percent. Both the conductive and semiconductive particles can be embedded in the surface layer of the elastomer by heating the elastomer above its glass transition temperature or by depositing a layer of adhesive onto the elastomer and spraying the particles onto the surface. The thickness of this layer can be from 0.1 micron to 100 microns, and preferably is from about 10 to about 50 microns with a harness of from about 10 A to about 60 A on the Shore durometer Scale.

As can be seen from FIG. 2, it is contemplated that the preferred embodiment of the present invention include support members 127, fixed within the housing 124 and situated I abutment with each donor blades 126, downstream from each donor blade 126 relative to the direction of travel 16 of the photoreceptor surface 12. The support members 127 is fabricated from a relatively rigid material with respect to the donor blades 126, providing structural integrity for urging the donor blade 26 against the photoreceptor surface 12. It has been found that a thin strip of MYLAR® provides an effective support member 27, although those of skill in the art will understand that various other materials and structures may be utilized to accomplish the same results.

In addition to the support blades 127, the alternative embodiment shown in FIG. 2 also includes a wiper blade 28. The wiper blade 128 is provided for removing any small amount of fluid from the surface of the photoreceptor 12, as may have been transferred thereto at the interface between the wetted donor blade 126 and the photoreceptor surface 12. Thus, a polyurethane type blade situated downstream from the donor blades 126 and support blades 127 relative to the direction of travel 16 of the photoreceptor surface 12 is provided for eliminating transfer of water or other liquid to the photoreceptor surface. The use of a wiper blade also advantageously permits a higher concentration of liquid to be applied by the donor blades 126. Clearly, the effectiveness of the wiper blade 128 can be enhanced by optimizing such factors as the liquid concentration at the donor blades 126/photoreceptor surface 12 interface, the wipe angle of the wiper blade 128 as well as the stiffness of the wiper blade 128. The wiper blade 128 also provides increased operational lifetime to the charging system of the present invention by returning the ionically conductive liquid to the donor blades 126 or to a reservoir coupled to the donor blade 126 for use in successive charging operations. In addition, a liquid management system (not shown) may be provided for adding liquid to the housing 124 of the charging apparatus 20 for continually moistening the donor blades 126.

It is noted that the fluid in housing 124 may be prevented from leaking out of the housing 124 by a lubricated rubber gasket or shoe 129. The rubber is selected to conform to asperities in the photoreceptor surface 12 and to any curvature in the photoreceptor, such as a drum 10.

In operation, the device of the present invention enables ionic conduction charging of a photoconductive imaging member, or any member placed in contact therewith, by placing an ionically conductive liquid component in contact with the surface of the photoconductive imaging member and applying a voltage to the ionically conductive liquid component such that ions are transferred across the liquid photoreceptive member interface to the photoreceptor surface. The photoreceptor thus becomes charged by the flow of ions through the liquid component. In simplest terms, the ionically conductive liquid is biased by a voltage approximately equal to the surface potential desired on the photoreceptor, causing ions to be deposited at the point of contact between the ionic liquid and the photoreceptor until the electric field thereacross is completely diminished.

In embodiments, the photoreceptor is charged by wetting a conductive foam component contained in a housing, with wedging rods attaching to foam components to separate voltages of a power supply 122. The photoreceptor is situated so as to contact the foam members. This voltage causes the $HCO_3$− and H30+ ions present in distilled or deionized water in equilibrium with air in the water to separate. When a positive voltage is applied from the power source, positive ions migrate toward the imaging member, and when a negative voltage is applied from the power source negative ions migrate toward the imaging member. Rotation or translation of the imaging member causes charge to transfer form the foam to the imaging member, which charge is substantially equivalent or equivalent to the voltage applied from the power source.

In a specific embodiment of the present embodiment, practiced in accordance with the present invention, each donor blade 126 is isolated from one another and independently coupled to an independent output port of power supply 122 such that each donor member is provided with an independent biasing voltage. Further, in accordance with the present invention, each donor blade 126 is independently biased to an incrementally increasing bias voltage which permits high level charge to be induced on the surface of a member in contact therewith while not exceeding the Paschen threshold voltage necessary to create air breakdown.

In review, the present invention is directed to an apparatus for charging photoreceptors by placing a multi-contact point conductive charging device in contact with the photoreceptor. The charging device includes multiple, separate and electrically isolated conductive blades which are independently electrically biased at predetermined voltage levels so as not to exceed a Paschen threshold voltage differential. Alternative embodiments have been disclosed incorporating conductive blade members, as well as ionically conductive liquid carrying donor members. In operation, the charging device of the present invention permits generation of a charge potential on the photoreceptor significantly greater than the Paschen threshold voltage, while avoiding air breakdown.

It is, therefore, apparent that there has been provided, in accordance with the present invention, a multi-point charging device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

I claim:

1. A charging device for applying an electrical charge to a member to be charged, comprising:

a plurality of electrically isolated conductive charging members, each of said conductive charging members comprising a donor member and an ionically conductive liquid for transporting ions to the member to be charged by the donor member, each of said conductive charging members being positioned in contact with the member to be charged at an independent sequential contact point therewith; and means for applying an independent electrical bias to each of said conductive charging members such that each of said conductive charging members is operative to create a charge potential on the member to be charged.

2. The charging device of claim 1, wherein the independent electrical bias applied to one of said conductive charging members does not exceed a Paschen threshold voltage relative to a voltage differential between said one conductive charging member and the charge potential on said member to be charged, and said electrical bias applied to another of said conductive charging members is greater than said Paschen threshold voltage of said voltage differential between said one conductive charging member and the member to be charged.

3. The charging device of claim 1, wherein the independent electrical bias applied to each of said plurality of conductive charging members is incrementally increased with respect to each independent sequential contact point thereof.

4. The charging device of claim 1, wherein each of said plurality of conductive charging members includes a blade member.

5. The apparatus of claim 4, wherein each blade member is fabricated from a conductive elastomer material.

6. The charging device of claim 1, wherein said donor member consists of a hydrophilic material selected from the group of polyurethane foam and polyvinylalcohol-co polyvinylformal foam.

7. The charging device of claim 1, wherein said donor member consists of a hydrophobic material selected from the group of VITON®, a copolymer of vinylidene fluoride/hexafluoropropylene, tetrafluoroethylene, polyethylene, polypropylene, polyethylpentane, polybutadiene and silicone elastomers.

8. The charging device of claim 1, wherein said ionically conductive liquid consists of a liquid selected from the group of distilled water, deionized water, polyhydroxyethylmethacrylates, polyacrylates, and polyvinylpyrrolodonone.

9. The charging device of claim 8, wherein said ionically conductive liquid includes water having an ionically conductive component added thereto, said ionically conductive component consists of a compound selected from the group of atmospheric carbon dioxide ($CO_2$), lithium carbonate, sodium carbonate, potassium carbonate, sodium bicarbonate, polyhydroxyethylmethacrylates, polyacrylates, polyvinylpyrrolodonone, gelatin, gums and mucilages both natural and synthetic.

10. An electrostatographic printing machine including a charging device for applying an electrical charge to an imaging member, comprising:

a plurality of electrically isolated conductive charging members each comprising a donor member and an ionically conductive liquid for transporting ions to the imaging member via the donor member, each of said conductive charging members being positioned in contact with the imaging member at an independent sequential contact point therewith; and means for applying an independent electrical bias to each of said conductive charging members such that each of said conductive charging members is operative to create a charge potential on said imaging member.

11. The electrostatographic printing machine of claim 10, wherein the independent electrical bias applied to one of said conductive charging members does not exceed a Paschen threshold voltage relative to a voltage differential between said one conductive charging one and the charge potential on said member to be charged, and said electrical bias applied to another of said conductive charging members is greater than said Paschen threshold voltage of said voltage differential between said one conductive charging member and the member to be charged.

12. The electrostatographic printing machine of claim 10, wherein the independent electrical bias applied to each of said plurality of conductive charging members is incrementally increased with respect to each independent sequential contact point thereof.

13. The electrostatographic printing machine of claim 10, wherein each of said plurality of conductive charging members includes a blade member.

14. A charging device for applying an electrical charge to a member to be charged, comprising:

a first conductive charging member having a donor member and an ionically conductive liquid for transporting ions to the member to be charged via the donor member, said first conductive charging member positioned in contact with the member to be charged at a first contact point whereat the member to be charged is at a substantially neutral electrical potential;

a first electrical biasing source coupled to said first conductive charging member for applying an electrical bias thereto which is less than a Paschen threshold voltage at which electrical discharge occurs between said first conductive charging member and said member to be charged;

a second conductive charging member having a donor member and an ionically conductive liquid for transporting ions to the member to be charged via the donor member, said second conductive charging member positioned in contact with the member to be charged at a second contact point adjacent the first contact point whereat the member to be charged is at an electrical potential induced by said first conductive charging member; and a second electrical biasing source coupled to said second conductive charging member for applying an electrical bias thereto which is greater than the Paschen threshold voltage level at which electrical discharge occurs relative to a voltage differential between said second conductive charging member and said member to be charged when at a substantially neutral electrical potential level, and which is less than the Paschen threshold voltage level at which electrical discharge occurs between said second conductive charging member and said member to be charged at an electrical potential induced by said first conductive charging member.

15. A method for applying an electrical charge to a member to be charged, comprising the steps of:

providing a first conductive charging member comprising a donor member and an ionically conductive liquid for transporting ions to the member to be charged via the donor member, said first conductive charging member positioned in contact with the member to be charged at a first contact point whereat the member to be charged is at a substantially neutral electrical potential;

applying an electrical bias to said first conductive charging member which is less than a Paschen threshold voltage at which electrical discharge occurs between said first conductive charging member and said member to be charged;

providing a second conductive charging member comprising a donor member and an ionically conductive liquid for transporting ions to the member to be charged via the donor member, said second conductive charging member positioned in contact with the member to be charged at a second contact point adjacent the first contact point whereat the member to be charged is at an electrical potential induced by said first conductive charging member; and applying an electrical bias to said second conductive charging member which is greater than the Paschen threshold voltage level at which electrical discharge occurs relative to a voltage differential between said second conductive charging member and said member to be charged when at a substantially neutral electrical potential level, and which is less than the Paschen threshold voltage level at which electrical discharge occurs between said second conductive charging member and said member to be charged at an electrical potential induced by said first conductive charging member.

* * * * *